US005287161A

United States Patent [19]

Matsuo et al.

[11] Patent Number: 5,287,161

[45] Date of Patent: Feb. 15, 1994

[54] COLOR IMAGE FORMING APPARATUS WITH A MULTICOLOR DETACHABLE PROCESS UNIT

[75] Inventors: Shunji Matsuo; Shizuo Morita; Satoshi Haneda; Masakazu Fukuchi; Seiko Naganuma; Masahiko Itaya; Fumiaki Hiraike, all of Hachioji, Japan

[73] Assignee: Konica Corporation, Tokyo, Japan

[21] Appl. No.: 741,192

[22] Filed: Jul. 30, 1991

Related U.S. Application Data

[63] Continuation of Ser. No. 516,046, Apr. 27, 1990, abandoned.

[30] Foreign Application Priority Data

May 9, 1989 [JP] Japan ..... 1-117124
May 29, 1989 [JP] Japan ..... 1-135334
Jul. 29, 1989 [JP] Japan ..... 1-197657

[51] Int. Cl.[5] ..... G03G 15/01

[52] U.S. Cl. ..... 355/326 R; 355/210; 355/260; 355/327

[58] Field of Search ..... 355/200, 210, 211, 245, 355/260, 326, 327, 271, 275, 277; 118/645; 346/153.1

[56] References Cited

U.S. PATENT DOCUMENTS 4,470,689 9/1984 Nomura et al. ..... 355/211
4,500,195 2/1985 Hosono ..... 355/208
4,569,582 2/1986 Hyltoft ..... 355/202
4,627,716 12/1986 Oka ..... 355/260 X
4,642,661 2/1987 Dean, II ..... 346/153.1
4,878,091 10/1989 Morita et al. ..... 355/260
4,924,267 5/1990 Yoshikawa et al. ..... 355/210
4,928,144 5/1990 Kasahara et al. ..... 355/245
4,937,625 6/1990 Kato et al. ..... 355/245
4,982,242 1/1991 Ishii et al. ..... 355/326
4,985,731 1/1991 Sakakura et al. ..... 355/210
4,994,853 2/1991 Fukuchi et al. ..... 355/208
5,030,988 7/1991 Haneda et al. ..... 355/200
5,045,885 9/1991 Nishio ..... 355/245
5,047,801 9/1991 Haneda et al. ..... 355/200

FOREIGN PATENT DOCUMENTS 0094071 5/1986 Japan .
0043189 2/1988 Japan ..... 355/327

*Primary Examiner*—A. T. Grimley
*Assistant Examiner*—Christopher Horgan
*Attorney, Agent, or Firm*—Frishauf, Holtz, Goodman & Woodward

[57] ABSTRACT

A color image forming apparatus for forming a color image comprising; an image retainer for carrying the color image, a charger for charging a surface of the image retainer, a latent image former for forming a latent image on the charged surface of the image retainer, a multicolor developer for developing the latent image, a black developer for developing the latent image, a transfer sheet conveyer for conveying a transfer sheet and transferring the developed latent image onto the transfer sheet, and a cleaner for cleaning a residual developer on the surface of the image retainer, in which the image retainer, either one of the black developer or the multicolor developer, and the cleaning means are formed as a detachable processing cartridge, and the rest of the black developer or the multicolor developer is detachable to the body of the color image forming apparatus.

1 Claim, 8 Drawing Sheets

COLOR IMAGE FORMING APPARATUS WITH A MULTICOLOR DETACHABLE PROCESS UNIT

This application is a continuation of application Ser. No. 07/516,046, filed Apr. 27, 1990 now abandoned.

BACKGROUND OF THE INVENTION

The present invention relates to a color image forming apparatus such as a color printer, a color copier and the like. The present invention especially relates to a color image forming apparatus which can form a color image of stable quality, be made compact, and meet the demand of forming a black and white image. Furthermore, the present invention relates to a color image forming apparatus that enables formation of a stable black and white image and which is in great demand.

It is also the principal object of this invention to provide an improved electrostatic color image forming apparatus in which: a photoreceptor drum and a developing unit are assembled into a cartridge so that the cartridge can be rapidly attached to and removed from the apparatus in order to easily clean and inspect the inside of the apparatus; and the cartridge can be easily and positively replaced with a new one when the cartridge has been used to the limit defined as the predetermined number of times in which image forming is conducted.

For example, a copier with a process cartridge has been disclosed in Japanese Patent Publication Open to Public Inspection No. 163276/1982, wherein the process cartridge is integrally composed of a photoreceptor drum, a charger, a cleaning unit and a black and white developing unit, and the process cartridge can be easily attached to and removed from the apparatus.

In this type of copier, the above-described process cartridge is replaced before parts and materials to be used to form an image have worn out beyond limits in order to avoid overworking the copier and to obtain a stable image quality.

In the copying machine industry, there is now an increased demand for a color image instead of a black and white image because a color image has much information. In order to meet the demand, a color copier has been disclosed in U.S. Pat. No. 4,500,195 issued to Hosono, wherein the color copier is provided with a color copy process cartridge which has a photoreceptor drum, a charger, a color developing device composed of a plurality of developing units, a cleaning unit and the like, and is provided with a black and white copy process cartridge with a black (BK) developing device so that the black and white copy process cartridge can be used as the spare of the color copy process cartridge.

However, the above-described color copy process cartridge has a complicated structure and is expensive since a plurality of developing devices are installed in it. In order to put the color copy process cartridge into practical use in terms of cost reduction, it is preferable that the above-described cartridge is replaced and discarded after its photoreceptor with long life has been used to its limits or the carrier in the developer has been used to its limits. The life of the above-described photoreceptor drum is usually 50000 to 80000 color copies and the life of the carrier contained in the developer is 20000 to 30000 color copies. Accordingly, toner is needed to be supplied from a toner supply unit provided to each of the plural apparatus, wherein each toner supply unit is corresponding to a developing unit. The toner supply unit is provided to the outside portion of the outer wall of the process cartridge and connected with the process cartridge at the connecting portion which has an opening to supply toner to the developing chamber of the developing unit.

However, in the case of the color image forming apparatus disclosed in the above-mentioned U.S. Pat. No. 4,500,195, the process cartridge must be replaced when the image forming mode is changed from the color image forming mode to the black and white image forming mode, or from the black and white image forming to the color image forming mode. Accordingly, it has the disadvantages of complicated operation, high cost, and waste of time.

There is a demand for a compact and light image forming apparatus as a printer and copier have become popular. Since the black and white image forming apparatus has been replaced with the color image forming apparatus, it has become very important to make the apparatus compact. However, in the case of the above-described color image forming apparatus disclosed in the U.S. Pat. No. 4,500,195, a plurality of developing units, a transfer means, and other image forming units are not arranged properly. Therefore, it has been difficult to make the above-described apparatus compact and to obtain a color image of stable quality.

The first example of the present invention aims to solve the problems described above. The object of the present invention is to provide a color image forming apparatus in which a color image forming process cartridge is adopted, and which is characterized in that: a color image of stable quality is obtained; the apparatus is made compact by the proper arrangement and composition of image forming units; and the image forming mode is easily converted from color image forming to black and white image forming without being restricted by a cartridge.

Furthermore, in the case of the above-described color image forming, apparatus disclosed in the U.S. Pat. No. 4,500,195, it has this disadvantage that the apparatus is stained by the toner which leaks out and dispersed when the toner supply unit is connected with the process cartridge at the connecting portion. In order to eliminate this disadvantage, a complicated sealing member to seal the connecting portion becomes necessary, wherein the sealing member is opened and closed when the toner supply unit is connected with and disconnected from the process cartridge. Especially, in the case of a color image forming apparatus, it is necessary to supply plural kinds of toner to a plurality of developing units. Accordingly, the structure becomes further complicated and even when a small amount of toner leaks out and disperses, the image quality is lowered because of color mixture caused by mixed toners.

The above-described color image forming apparatus has the further disadvantages, that color mixture tends to occur, and that it is difficult to maintain stability of the apparatus to acquire balance because a plurality of developing units stacked horizontally in the process cartridge are horizontally provided close to the photoreceptor drum. The above-described color image forming apparatus has the further disadvantage, that the transfer and conveyance means of transfer paper tends to be stained by the toner which leaks out and disperses because the means is located below the photoreceptor drum.

In order to solve the problems described above, the second example of the present invention has been offered. The object of the second example is to provide a color image forming apparatus characterized in that: the quality of a black and white image is stabilized by adopting a black and white process cartridge; the image quality is improved and the apparatus is made compact by a proper arrangement and composition of image forming units; and by providing color developing units to the apparatus the image forming mode is easily converted from the black and white copying mode to the color copying mode without restrictions of the process cartridge.

Conventionally, some types of electrostatic image forming apparatuses have been used. One is characterized in that a photoreceptor drum and a developing unit are provided to a unit which can be rapidly attached to and removed from the apparatus. The other is characterized in that a unit including a photoreceptor drum and a unit including a developing unit are individually provided to the apparatus, wherein both units can be rapidly attached to and removed from the apparatus. The above-mentioned electrostatic image forming apparatuses are formed in such a manner that the inspection of the inside of the apparatus, the exchange of parts, and the cleaning of the inside of the apparatus can be easily and positively conducted.

The life of a photoreceptor which is repeatedly used to form images, is limited. For example, the photoreceptor is generally replaced with a new one when it has been used to the limit defined as the number of times in which the photoreceptor has been used to form images, wherein the number of times can be 10000, 30000, or 50000 times. The life of a developing unit is limited in the same way as the photoreceptor. The photoreceptor is commonly replaced with a new one when it has been used to the limit.

The photoreceptor and the developing unit have the endurance limit within which an image of good quality can be formed. The endurance limit is determined by the number of times in which images have been formed. When the photoreceptor is used to the limit, it is suddenly degraded. For that reason, the photoreceptor must be replaced with a new one before it has been worn beyond the limit. In the case of a developing unit, although the endurance limits of Y, M, C, and BL developing units are the same, the frequency of use of each developing unit is different when multicolor image forming is conducted. Accordingly, each developing unit reaches the limit of use at different times. In many cases, the frequency of use of the black developing unit is high and the frequency of use of the color developing unit is not so high. In the case described above, if each color developing unit is discarded on the assumption that each color unit has worn out synchronously with the black developing unit, it will amount to discarding color developing units which still have enough capacity, which can be considered enormous losses from the view point of economical use of color developer and color developing units.

In the case of multicolor image forming, the frequency of use of Y, M, and C developers or of B, G, and R developers can be regarded as almost the same.

The third example of the object of the present invention is to provide an electrostatic image forming apparatus in order to solve the above-described problems, wherein the electrostatic image forming apparatus is characterized in that: a cartridge is provided in which the units having the same frequency of use are built so that the work of inspection, cleaning and replacing parts can be conducted precisely and easily, and furthermore the photoreceptor, the developing unit and the cleaning unit can be utilized until they wear out to the limit.

SUMMARY OF THE INVENTION

The object of the above-described first example can be attained by a color image forming apparatus which has a photoreceptor drum, a charger around the drum, a group of developing units including a color toner developing unit and a black toner developing unit, a cleaning unit, and a transfer and conveyance means of transfer paper, and which is characterized in that; a process cartridge is provided which is easily attached to and removed from the apparatus, wherein the color toner developing unit, the photoreceptor drum, and the cleaning unit are integrally mounted on the process cartridge; the black toner developing unit is provided to the apparatus; a group of developing units including the color toner developing unit and the black toner developing unit are provided below the photoreceptor; and the transfer and conveyance means is provided above the photoreceptor drum.

The color image forming apparatus of the present example is characterized in that; the charger, multicolor developer unit for example the Y, M, and C (Yellow, Magenta, and Cyan) developing units, the cleaning unit, and the waste toner collecting container are provided around the photoreceptor drum and they are integrally built in the process cartridge; the process cartridge is provided to the apparatus, wherein the cartridge can be easily attached to and removed from the apparatus; and the BK (black) developing unit is singly provided to the apparatus, wherein the BK developing unit can be easily attached to and removed directly from the apparatus. The above-described composition in which the process cartridge is adopted, offers advantages which will be described as follows: the stabilization of color image quality can be ensured; the apparatus can be made compact; the BK developing unit can be easily replaced when the toner has been consumed or the developer has been worn out without being restricted by the process cartridge; and not only color image forming but also a large amount of black and white image forming can be stably accomplished.

The color image forming apparatus of the present example is characterized in that: the composition of the apparatus acquires balance, maintains stability and is made compact, and furthermore the quality of a color image and a black and white image is improved by locating the Y, M, C, and BK developing units below the photoreceptor drum, and by locating the transfer and conveyance means of transfer paper above the photoreceptor.

It is preferable that the above-described developing units are vertically provided around the photoreceptor drum and the Y, M and C color developing units share some portions of walls which separate the developing units so that the developing units are integrally composed. The developer used in the developing units may be either one-component developer mainly composed of magnetic toner or two-component developer composed of nonmagnetic toner and magnetic carrier. However, it is preferable to use the above-described two-component developer so that clear image tone of coloring agents can be obtained.

The above-described process cartridge is continuously used to form an image until the carrier in the developer or the photoreceptor has been used out to limits. When one of them reaches the limits, it is removed from the apparatus to be replaced. Since there is not enough room in the developing chamber of the color developing unit located in the process cartridge, it is preferable that toner is supplied to the color developing unit from the toner supply unit located on the front side or on the rear side of the apparatus. As far as the BK developing unit provided to the apparatus is concerned, the toner chamber may be provided in the developing unit and toner may be supplied from the toner chamber (toner hopper) to the developing chamber, and when the toner has been consumed, the developer may be replaced. A toner container which is filled with toner may be attached to or removed from the developing chamber in order to supply toner, and the developing unit may be replaced when the developer, especially the carrier, has been worn out. Furthermore, a toner supply hopper may be provided so that the toner can be supplied to the developing chamber from the outside of the apparatus.

As the developing units have the structure and arrangement described above, the process cartridge is made further compact and its arrangement becomes stable. Furthermore, as the developer is sufficiently charged by triboelectric charging when the developer is stirred and mixed, excellent development is conducted and the color image of high quality is obtained. Since the transfer and conveyance means of transfer paper is located above the photoreceptor drum, the means is not stained by the toner which is leaked out from the developing units.

In order to efficiently obtain fine color images or fine black and white images over long periods of time, it is preferable that: a waste toner collecting container is provided in the process cartridge; the residual toner on the surface of the photoreceptor drum is scraped off; and the collected waste toner is put into the waste toner collecting container by a waste toner conveyance pipe which has a screw conveyer or a coil spring. Instead of the above-described waste toner collecting container, the inside of the photoreceptor drum can be used as the room to put the waste toner into.

The color image forming process and the black and white image forming process are stored beforehand in the program memory, and when image forming is conducted, one of the image forming processes is selected by operating the program operation key provided to the apparatus in order to form an image according to the image forming process selected through the control unit.

The object of the second example of the present invention can be accomplished by the color image forming apparatus which has a photoreceptor, a charger around the photoreceptor, a group of developing units including a color toner developing unit and a black toner developing unit, a cleaning unit, and a transfer and conveyance means of transfer paper, and which is characterized in that: a process cartridge is integrally composed of the black toner developing unit, the photoreceptor drum, and the cleaning unit, wherein the process cartridge can be easily attached to and removed from the apparatus; the color developing unit is provided to the apparatus; the above-described group of developing units are located below the photoreceptor drum; and the above-described transfer and conveyance means is located above the photoreceptor drum.

The color image forming apparatus of the present example, is characterized in that: the charger, the BK developing unit, the cleaning unit, and the waste toner collecting container, if necessary, are integrally located around the photoreceptor and built in the process cartridge; the process cartridge is easily attached to and removed from the apparatus; and the color developing unit of yellow (Y), magenta (M), and cyan (C) is provided to the apparatus directly. Since the image forming apparatus of the present example has such a structure as described above, an inexpensive disposable process cartridge for use in forming a black and white image is realized. As a color developing unit is installed as an optional unit in this example, the black and white image forming mode is rapidly converted to the color image forming mode and the color mode is rapidly converted to the black and white mode without replacing the process cartridge.

Since the color developing unit is provided to the apparatus, it has the advantage, that the developing unit can be replaced in need without interfering with the process cartridge, and that the toner supply unit is easily provided to the color developing unit.

Furthermore, the image forming apparatus of the present invention is characterized in that: the apparatus is composed to acquire balance to maintain stability, the apparatus is made compact, and furthermore the quality of a black and white image and a color image is improved by locating a group of developing units including the color developing unit and the BK developing unit below the photoreceptor, and by locating the transfer and conveyance means of transfer paper above the photoreceptor.

A toner supply chamber is provided to the BK developing unit in the process cartridge. When the toner in the toner supply chamber has been consumed, the process cartridge is replaced. Otherwise, a toner supply unit may be added to the above-described developing unit and the toner may be supplied to the developing unit from the toner supply chamber until the carrier in the developer has been worn out to limits, and when the carrier has been worn out beyond limits, the process cartridge may be replaced. Alternatively, the BK developing unit in the process cartridge may be made replaceable, and when the photoreceptor has been worn out to limits, the process cartridge may be replaced.

In order to effectively continue forming black and white images which are in great demand, it is preferable that: a waste toner collecting container is provided in the process cartridge; the residual toner on the surface of the photoreceptor is scraped off; and the collected waste toner is conveyed to the waste toner collecting container by a waste toner conveyance pipe to which a screw conveyer or a coil spring is provided. The waste toner may be put into the inside of the photoreceptor drum instead of the waste toner collecting container. It is preferable that the toner is supplied to the Y, M, and C color developing units from toner supply hoppers which are provided on the front side of the apparatus or on the rear side of the apparatus. When the toner has been consumed or the carrier has been worn out, the color developing unit may be replaced individually or as a unit if necessary. When an image is formed by the color image forming apparatus of the present invention, the process to form a black and white image and that to form a color image are stored beforehand in the program memory. One of the processes is selected by operating a key to be used for program operation so that the desired image forming process can be performed through a control unit.

The above-described object of the third example can be attained by the electrostatic image forming apparatus in which a color image can be formed, and which is characterized in that: a drum cartridge to which a photoreceptor drum is provided, a color developing unit cartridge to which a plurality of color developing units are provided, and a black developing cartridge to which a black developing unit is provided, are separately provided to the apparatus.

DETAILED DESCRIPTION OF THE INVENTION

Figure 1:
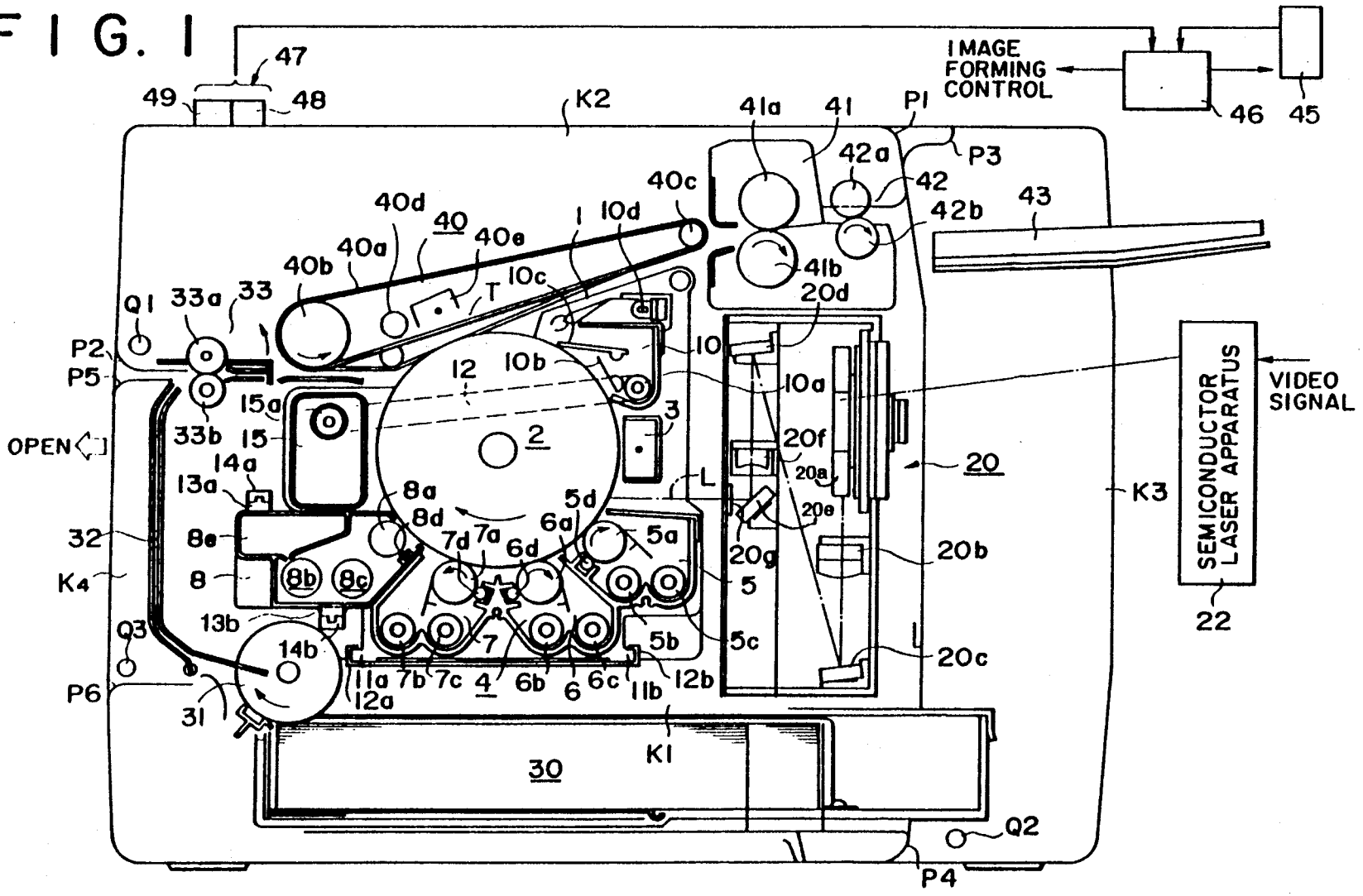
FIG. 1 is a sectional view of the color printer of the first example.

FIG. 1 is a sectional view of the color printer of the first example. The numeral 1 is a process cartridge in which the photoreceptor 2, the charger 3, the color developing unit 4, the cleaning unit 10, and the waste toner collecting container 15 are provided. The developing unit 4 comprises the Y developing unit 5, the M developing unit 6, and the C developing unit 7, wherein the above developing units share some portions of the walls of the developing unit 4, and are integrally composed. The developing rollers 5*a*, 6*a*, and 7*a*, the stirring rollers 5*b*, 5*c*, 6*b*, 6*c*, 7*b*, and 7*c*, and the layer thickness regulating rollers 5*d*, 6*d*, and 7*d*, are provided in the above-described developing units. The developing rollers and the stirring rollers are vertically located in the developing units. The developing units are located below the photoreceptor drum 2 so that the developing units surround the circumferential surface of the photoreceptor 2. The cleaning unit 10 has the waste toner collecting tube 10*a*, the waste toner collecting film 10*b*, the cleaning blade 10*c*, and the discharge lamp 10*d* used before cleaning. The waste toner scraped off from the surface of the photoreceptor by the blade 10*c*, is collected to the toner collecting tube 10*a* through the waste toner collecting film 10*b*. The toner collecting tube 10*a* is connected with one end of the waste toner conveyance tube 12 and the other end of the waste toner conveyance tube 12 is connected with the waste toner recovery tube 15*a* in the waste toner recovery container 15. Accordingly, the waste toner which has been scraped off is collected to the toner recovery container 15 through the waste toner conveyance tube 12.

The BK developing unit 8 is separated from the process cartridge 1, wherein the developing unit can be rapidly attached to and removed from the apparatus without being restricted by the process cartridge. Therefore, the BK developing unit 8 can meet the demand to form a plurality of black and white images, which is the important characteristics of the present invention.

The numeral 20 is an optical unit for laser beams to expose an image. The optical unit 20 for laser beams has the polygon mirror 20*a*, the collimator lens 20*b*, the reflection mirror 20*c*, 20*d*, and 20*e*, the f-$\theta$ lens 20*f*, and the dustproof type glass 20*g*. The letter L is an exposure light beam. The semiconductor laser beams modulated by the video signal sent from the outside of the apparatus, are introduced to the optical unit 20, and the surface of the photoreceptor drum is exposed to the image exposing light L to form an electrostatic latent image.

The numeral 30 is a transfer paper feed cassette. Transfer paper which is sent by the feed roller 31 from the paper feed cassette 30, is conveyed to the transfer region through the conveyance passage 32 and the upper conveyance roller 33*a* and the lower conveyance roller 33*b* of the conveyance rollers 33.

The numeral 40 is a transfer and conveyance unit. The numeral 40*a* is a transfer and conveyance belt. The numeral 40*b* and the numeral 40*c* are drive rollers to drive the belt 40*a*. The numeral 40*d* is a belt tension roller. The numeral 40*e* is a transfer pole. The numeral 41 is a fixing unit which is composed of the press roller 41*a* and the heat roller 41*b*. A fixed transfer paper is delivered to the delivery tray 43 by the upper delivery roller 42*a* and the lower delivery roller 42*b* of the delivery rollers 42.

The apparatus is composed of the upper box unit $K_2$ and the lower box unit $K_1$, and the boundary between $K_2$ and $K_1$ is the line $P_1$–$P_2$. The upper box unit $K_2$ can be opened with regard to the line $P_1$–$P_2$, wherein the upper box unit $K_2$ comprises the upper transfer paper conveyance roller 33*a*, the transfer and conveyance unit 40, the press roller 41*a* of the fixing unit 41, and the upper delivery roller 42*a*, wherein the lower box unit $K_1$ comprises the process cartridge 1, so that a transfer paper jam which occurs in the transfer and conveyance system can be recovered.

When the side lid $K_3$ including the delivery tray 43 is opened with regard to the boundary $P_3$–$P_4$, the transfer paper feed cassette 30 can be attached to and removed from the apparatus. A transfer paper jam which occurs in the transfer paper conveyance process, can be treated by swinging the side lid $K_4$ around its axis which includes one side of the conveyance passage, with regard to the boundary $P_5$–$P_6$.

Figure 2:
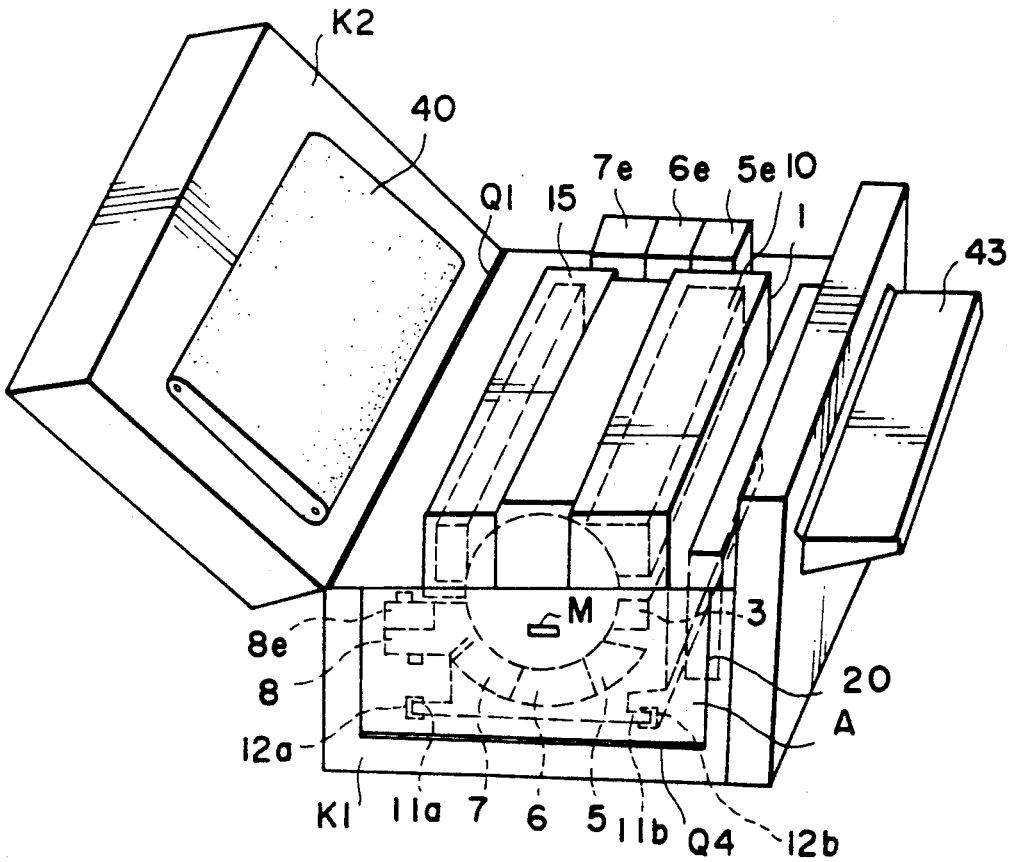
FIG. 2 is a perspective view of the color printer illustrated in FIG. 1

Referring to FIG. 1 and FIG. 2, details of how the process cartridge 1 is attached to and removed from the apparatus will be explained. In FIG. 1, the upper box unit $K_2$ is opened around the shaft $Q_1$ as a center and the upper box unit $K_2$ is opened from the lower box unit $K_1$, which includes the process cartridge 1, with regard to the boundary $P_1$–$P_2$. Then, the front door A is opened toward the viewer's side by pulling the handle M and the front side of the apparatus is opened. After that, the lower protrusions 11*a* and 11*b* of the process cartridge 1 are slid along the guide rails 12*a* and 12*b*. In this way, the process cartridge 1 is pulled out toward the viewer's side to be replaced. In the case of the BK developing unit 8 which is one of the characteristics of the present invention, the front door A is opened to the viewer's side in the same way as described above, and the sliding members 13*a* and 13*b*, which engage with the guide rails 14a and 14b, are slid so that the BK developer 8 can be pulled out.

The developing roller 8a, the stirring rollers 8b and 8c, and the layer thickness restricting rollers 8d and 8e are included in the above-described BK developer 8. Toner is supplied to the color developing units 5, 6, and 7 of Y, M, and C from the toner supply units 5e, 6e, and 7e which are provided at the rear of the apparatus.

Image forming of the present example was carried out by the above-described color image forming apparatus as follows. The color process stored in the memory 45 was read out beforehand by operating the color process designation key 48 in the process designation keys 47, and the color process was designated through the CPU 46. According to a color video signal, an image was formed by the color developing units of Y, M, and C in the process cartridge and by the BK developing unit provided to the apparatus.

First of all, the cleaning unit was released and at the first rotation of the photoreceptor drum 2 the circumferential surface of the photoreceptor drum 2 was uniformly charged by the charger 3 so that the drum 2 was charged to the electrical potential −700 V. Then, the laser beams emitted from the semiconductor laser unit 22 were modulated by the signal Y which was the first video signal, and the surface of the photoreceptor drum 2 was exposed to the thusly modulated laser beams to form an electrostatic latent image. Then the latent image was developed by the Y developing unit 5 containing two-component developer on which the developing bias of D.C component −600 V and A.C component 3 KHz, 500 V, was impressed, wherein the development was conducted by the method of noncontact reversal development. In this way, a Y toner image was formed on the photoreceptor drum.

At the next stage, the photoreceptor drum 2 was rotated and charged by the charger 3 to the electrical potential −700 V again. Then the photoreceptor was exposed to the laser beams modulated by M signals and the latent image was developed by the M developing unit 6. In this way, an M toner image was superimposed on the Y toner image previously formed on the photoreceptor. In the same way, at the third revolution and the fourth revolution of the photoreceptor drum 2, the photoreceptor drum was exposed to the laser beams modulated by C signals and BK signals. Then, reversal development by the C developing unit 7 and the BK developing unit 8 was conducted in order to superimpose the C toner image and the BK toner images onto the previously formed Y and M toner image. The color toner image was formed in this way. Image forming of the M toner image, the C toner image, and the BK toner image was carried out under the same condition as image forming of the Y toner image.

Then, a transfer paper was sent out by the paper feed roller 31 from the paper supply cassette 30 according to the predetermined image forming program. Then the transfer paper was conveyed by the transfer belt 40a to the transfer region T through the conveyance passage 32. The color toner image on the photoreceptor 2 was transferred onto the above-described transfer paper by the transfer pole 40e in the transfer region T. The transferred image on the paper was fixed by the heat roll 41b of the fixing unit 41. Then the transfer paper was delivered onto the delivery tray 43 by the delivery rollers 42, wherein the transfer paper was delivered face down. After the color toner image was transferred onto the transfer paper, the above-described cleaning unit was turned on and the residual toner on the photoreceptor 2 was removed from the surface of the photoreceptor so that the photoreceptor 2 was ready for the next image formation. The above-described operation was repeated 1000 times so as to form color images: The color toner was successively supplied to the developing unit 4 from the toner supply units 5e(Y), 6e(M), and 7e(C) and the BK toner was stably supplied from the toner chamber 8e in the BK developing unit 8 during the image forming. Accordingly, clear images of high density could be obtained from the beginning of the operation to the end.

Then the image forming process was changed to the black and white image forming process by operating the monochrome (black) process designation key 49 of the process designation key 47, and images were formed with the BK developing unit 8 according to the black and white video signal.

The electrical potential of −700 V was uniformly impressed on the surface of the photoreceptor drum 2 by the charger 3 while the cleaning blade 10c came into contact with the photoreceptor 2. Then, the laser beams modulated according to the BK video signal, were emitted from the laser unit 22 and the surface of the photoreceptor drum 2 was exposed to the modulated laser beams through the optical laser unit 20 so that an electrostatic latent image could be formed. This electrostatic latent image was developed by the BK developing unit 8 which contained two-component-developer and on which the bias of D.C component −600 V and A.C component 3 KHz, 500 V was impressed, wherein noncontact reversal development was conducted. A BK toner image was formed on the surface of the photoreceptor 2 in this way. This BK toner image was transferred and fixed onto the transfer paper sent from the paper supply cassette 30 so that the BK image could be formed. After the image was transferred onto the transfer paper, the photoreceptor drum was cleaned by the cleaning unit 10. The above-described operation was repeated 5000 times to form black and white images. While the operation was repeated, the BK developing unit was replaced, wherein the replacement was conducted having no relation with the process cartridge 1, to continue image forming. As a result, clean images of high density could be obtained.

In this example, image formation could be conducted over long periods of time by putting the waste toner scraped off from the surface of the photoreceptor 2 by the cleaning unit to the waste toner collecting container 15.

In the above-described example, the present invention was applied to a color printer. If the color printer is combined with a color scanner, the apparatus can be a color copier. The present invention includes the color copier described above.

It is clear from the above explanations that in the color image forming apparatus of the present invention the apparatus can be made compact; the arrangement of image forming units can be made stable; the conversion between a color image and a black and white image can be rapidly conducted without being restricted by the process cartridge; and furthermore the image of stable quality can be obtained.

Figure 3:
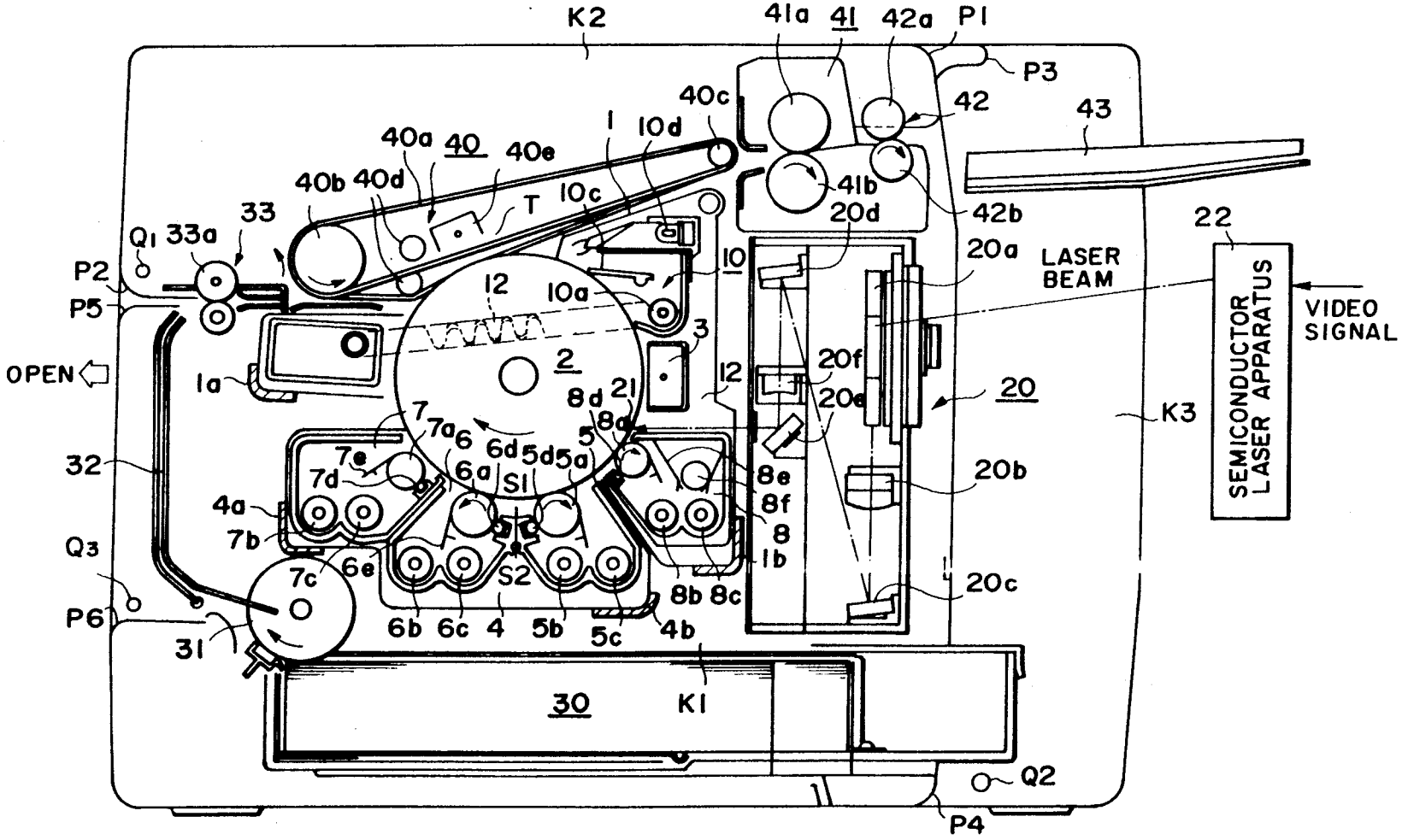
FIG. 3 is a sectional view of the color printer of the second example.

FIG. 3 is a sectional view which explains the color printer of the second example of the present invention. In FIG. 3, the numeral 1 is a process cartridge. The photoreceptor drum 2, the charger 3, the BK developing unit 8, the cleaning unit 10, and the waste toner collecting container 15 are provided in the process cartridge 1. The developing roller 8*a*, the stirring rollers 8*b*, 8*c*, the layer thickness restricting roller 8*d*, the developer scraping member 8*e* (the scraper) used for scraping the developer from the photoreceptor after development, and the toner supply cylindrical member 8*f* are provided in the above described BK developing unit 8. A plurality of black and white images can be printed as the toner is successively supplied from the toner supply cylindrical member 8*f*.

The cleaning unit 10 has the waste toner collecting tube 10*a*, the waste toner collecting film 10*b*, the cleaning blade 10*c*, and the discharge lamp 10*d* used before cleaning. The wasted toner scraped off from the surface of the photoreceptor 2 is collected to the waste toner collecting tube 10*a* through the waste toner collecting film 10*b*. The waste toner collecting tube 10*a* is connected with one end of the waste toner conveyance tube 12 which is provided on the front side of the apparatus, and the other end of the waste toner conveyance tube 12 is connected with the waste toner recovery tube 15*a* of the waste toner recovery container 15. The scraped waste toner is recovered into the waste toner recovery container 15 through the waste toner conveyance tube 12.

The charger 3 is a scorotron charger with a grid and its discharging wire can be cleaned by a manually operated cleaning means. The color developing unit 4 comprises the Y developing unit 5, the M developing unit 6, the C developing unit 7, wherein the developing units are integrally assembled sharing some portions of the walls located between them, and each developing unit can be easily attached to and removed from the apparatus. The developing units have the developing rollers 5*a*, 6*a*, 7*a*, the stirring rollers 5*b*, 6*b*, 7*b*, 5*c*, 6*c*, 7*c*, the layer thickness restricting rollers 5*d*, 6*d*, 7*d*, and the scrapers 5*e*, 6*e*, 7*e*. This color image developing unit 4 can be replaced according to the demand of a user without being restricted by the process cartridge 1. In the present example, toner hoppers to supply the toner are provided to the Y, M, and C developing units so that color images can be successively formed until the carrier in the developer is worn out to its limits.

As the developing rollers and the stirring rollers of the BK developing unit 8 and the color developing unit 4 are vertically located, the efficiency of stirring and mixing is high enough that sufficient triboelectric charging can be conducted to the developer.

The above-described developing units are located below the photoreceptor drum 2, wherein the developing units surround the circumferential surface of the photoreceptor. Accordingly, the apparatus can be made further compact.

Figure 4:
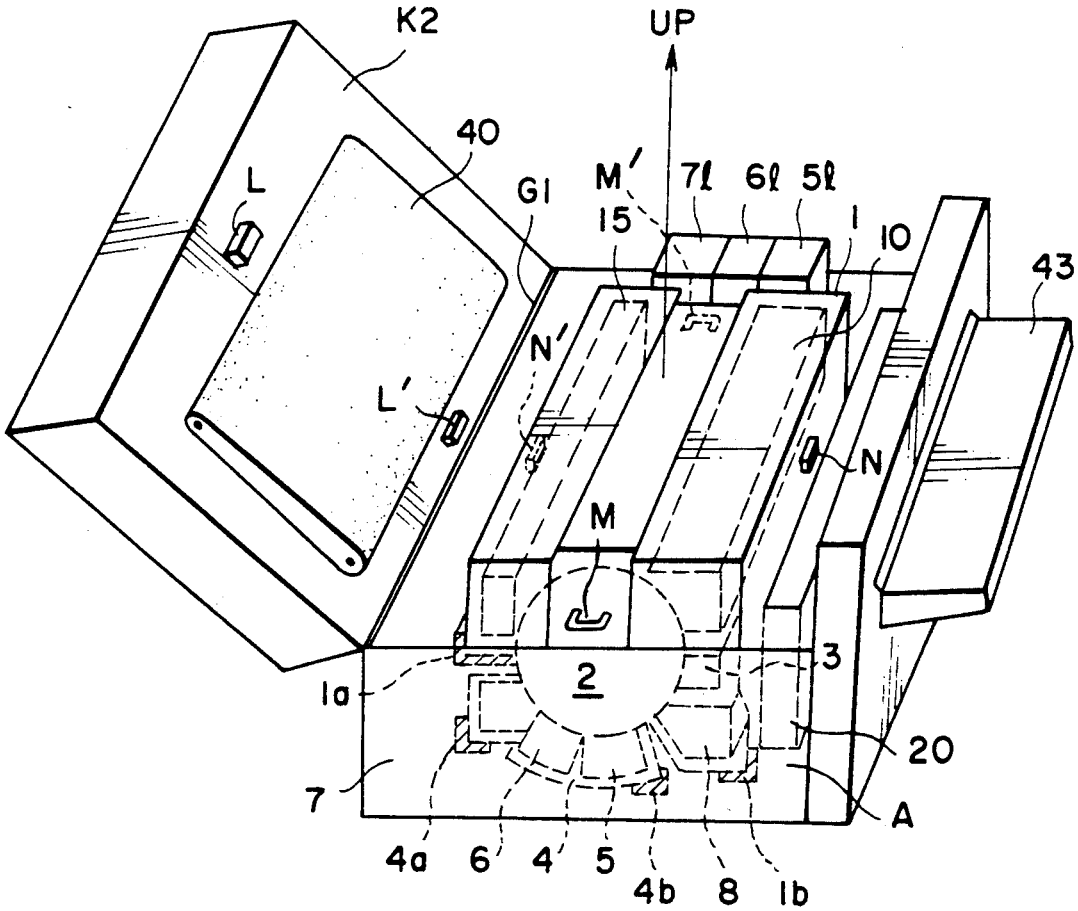
FIG. 4 is a perspective view of the color printer illustrated in FIG. 3.

Referring to FIG. 3 and FIG. 4, the way to attach the process cartridge 1 and the color developing unit 4 to the lower box unit $K_1$ and how to remove them from it, will be explained as follows. First of all, in order to remove the process cartridge 1 and the color developing unit 4 from the lower box unit $K_1$, the upper box unit $K_2$ is opened around the shaft $Q_1$ as a center with regard to the lower box unit $K_1$. Then, the handle M located on the front side of the cartridge and the handle M' located on the rear side of the cartridge are held and the process cartridge 1 is drawn up to remove the cartridge from the apparatus. Successively, the color developing unit 4 located below the process cartridge 1 is drawn up in the same way.

In order to attach the process cartridge 1 and the color developing unit 4 to the lower box unit $K_1$, the color developing unit 4 is forced to engage with the unit receivers 4*a*, 4*b*, and then the process cartridge 1 is forced to engage with the cartridge receivers 1*a*, 1*b* provided to the lower box unit $K_1$. After that, the upper box unit $K_2$ is closed to the lower box unit $K_1$ so that the apparatus becomes ready to form an image. When the upper box unit $K_2$ is closed, the protrusion N (N') provided to the process cartridge 1 is pressed downward by the protrusion L (L') provided to the upper box unit $K_2$ so that the process cartridge can be fixed to the cartridge receivers 1*a*, 1*b*. The gap between the photoreceptor drum 2 and the color developing unit 4 is maintained by a bumping member which is not shown in the drawings. When the upper box unit is closed, the color developing unit is also fixed to the unit receivers 4*a*, 4*b* through the above-described bumping member.

The image forming process in the second example is the same as that in the first example. The BK toner image in the second example was transferred and fixed onto the transfer paper sent from the transfer paper supply cassette 30 and the BK image was formed. After transferring, the photoreceptor drum 2 was cleaned by the cleaning unit 10. When image forming was conducted 25000 times while toner was supplied to the developing unit from the cylindrical toner supply member 8*f*, the process cartridge was replaced in case the carrier was worn out, and image forming was successively carried out. As a result, a clear black and white image of high density could be obtained. Other characteristics of the obtained images were the same as those in the first example.

It is clear from the above explanations that according to the image forming apparatus of the present example; the apparatus can be made compact; the image forming units can be arranged stable; the conversion between color image forming and black and white image forming can be rapidly carried out without being restricted by the process cartridge; black and white images which are in great demand can be stably printed; and additionally color images can be printed.

The third example of the present invention is illustrated in FIG. 5, 6, 7, and 8.

Figure 5:
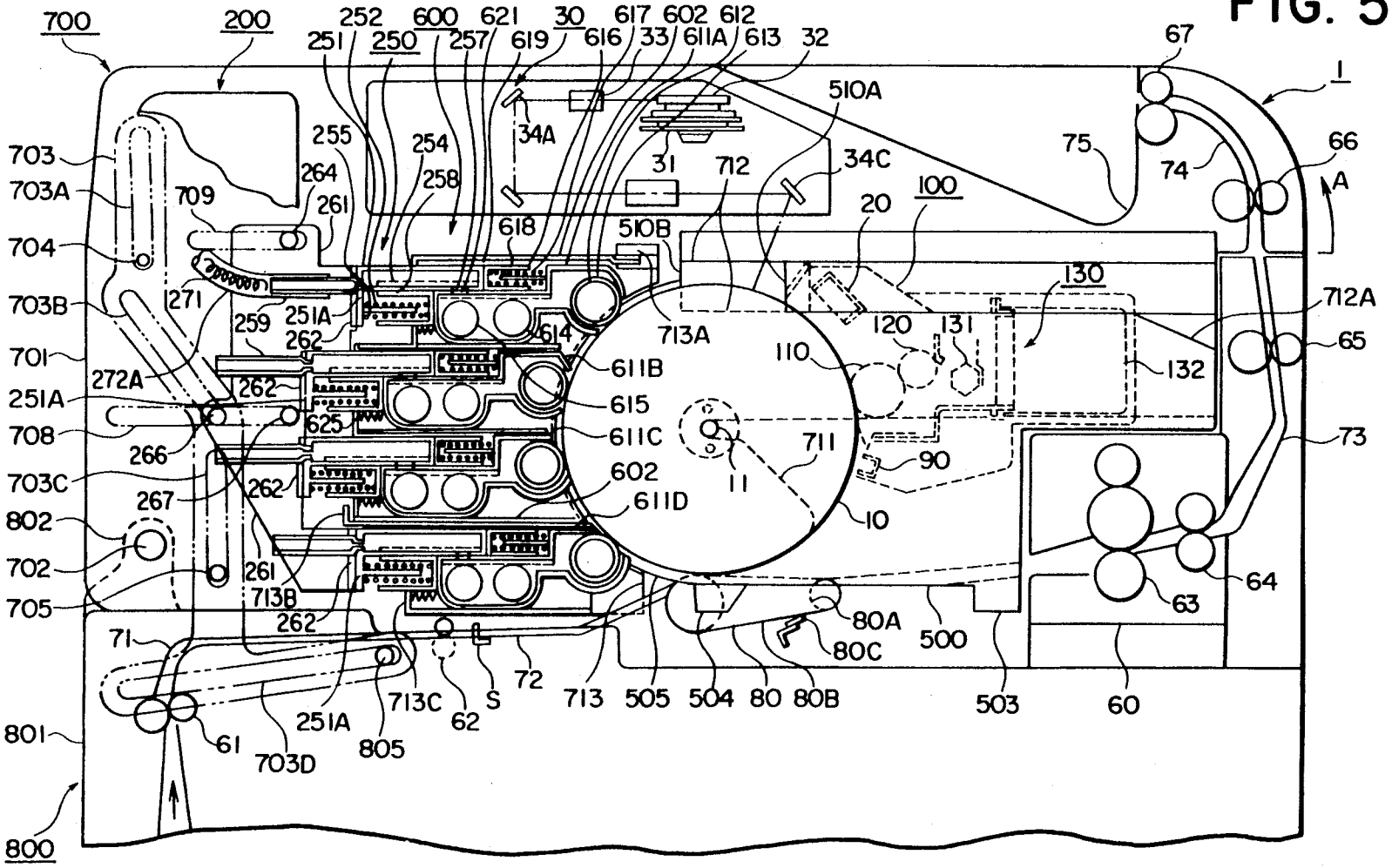
FIG. 5 is a left side sectional view of the third example of the present invention.
Figure 6:
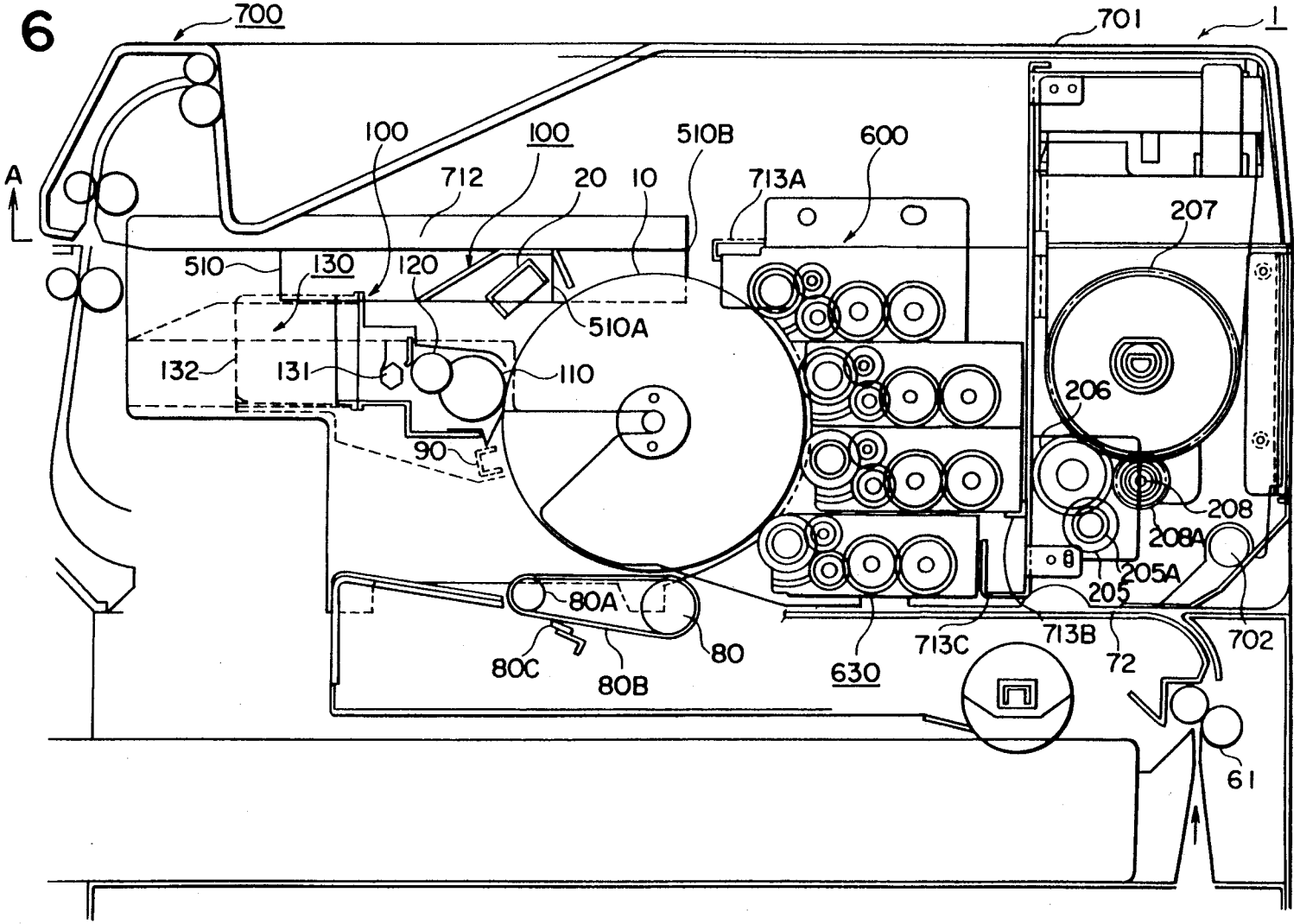
FIG. 6 is a right side sectional view of the third example of the present invention.

FIG. 5 and 6 are sectional side views of the electrostatic image forming apparatus of the present invention. FIG. 5 is a sectional view taken on line X-X' of FIG. 7 which is the plan view of the example of the present invention.

In the drawings, the numeral 10 is a photoreceptor which is rotated clockwise in FIG. 6 and counterclockwise in FIG. 5. The numeral 20 is a charging electrode which impresses electrical potential on the surface of the photoreceptor 10. The numeral 30 is a laser writing unit which is an optical exposure system.

The image forming method in the third example is the same as that in the first and the second examples.

The composition of the developing unit 600 will be explained as follows. The developing unit 600 is composed of the developing unit 611A in which Y (yellow) developer is contained, the developing unit 611B in which M (magenta) developer is contained, the developing unit 611C in which C (cyan) developer is contained, and the developing unit 611D in which BL (black) developer is contained. The above-described Y, M, and C developing units are integrally provided to the cartridge frame 602 to form a color developing unit. They can be rapidly attached to and removed from the apparatus through the opening 713 being guided by the guide rails 713A and 713B, wherein the opening 713 is provided to the frame 701 of the clam-shell opening and closing unit 700 which is formed in the upper portion of the base unit 800 of the image forming apparatus 1. The developing unit 611D in which the black developer is contained, can be attached to and removed from the apparatus through the opening 713 being guided by the guide rails 713, wherein the black developing unit 611D can be set to the apparatus independently from the above-mentioned clam-shell opening and closing unit 700.

The four developing units described above have almost the same structure. The structure of the developing unit 611A will be explained as follows. The developing roller (the developing sleeve) 612 and the stirring rollers 614 and 615 are provided in the developing unit container. The outer diameter portions 613 are provided to both sides of the developing roller 612, wherein the outer diameter of the outer diameter portions 613 is larger than that of the developing roller 612. As illustrated in FIG. 6, the gear train 630 through which the driving force is transmitted, is provided on the right side of the developing unit container. The toner receiving inlet 621 is provided on the left side of the developing unit container.

Figure 7:
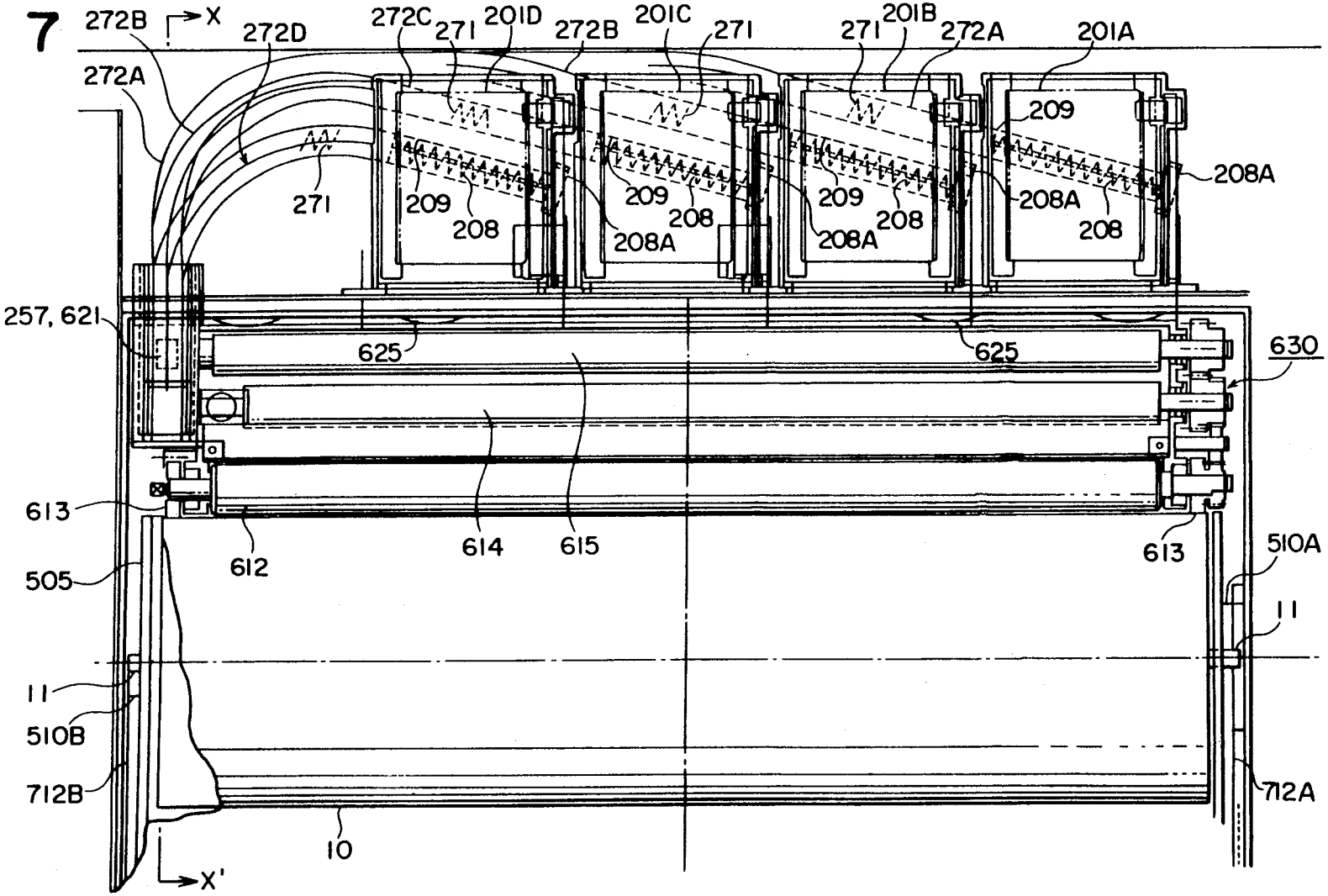
FIG. 7 is a drawing which illustrates the upper portion of the apparatus of the third example of the present invention.

The opening and closing member 618 which is pushed by the spring 617 and the guide pin 616, is provided along the rail 619 mounted on the developing unit container so that the opening and closing member 618 can close the toner receiving inlet 621 in FIG. 7.

The developing unit container is pushed by the spring 625 (this spring may be either a leaf spring or a coil spring) so that the outer diameter portions 613 provided to both sides of the developing roller 612 can come into contact with the surface of the photoreceptor 10 with pressure. Accordingly, the gap between the developing rollers 612 and the photoreceptor drum 10 can be maintained to be the most adequate distance in order to form a magnetic brush.

The toner supply tank 200 and the toner supply unit 250 will be explained as follows.

Concerning the tank 200, as illustrated in FIG. 6 and 7, the containers 201A, 201B, 201C and 201D in which the toners of Y, M, C and BL are contained, are provided in a line to the frame 701 of the clam-shell opening and closing unit 700, wherein the shapes of the containers are the same. The stirring shafts and the spiral rotary shafts 208 of the containers 201A, 201B, 201C and 201D are driven by the motor 205 through the gears 205A, 206, 207 and 208A. The spiral shafts 208 are provided to the toner supply and conveyance inlets 209 of the above-described tank 200 and the ends of the hoses 272A, 272B, 272C and 272D are connected with the toner supply and conveyance inlets 209. The flexible spiral members 271 connected with the spiral rotary shafts 208 are provided in the hoses. When the spiral rotary shafts 208 are rotated, the flexible spiral members 271 are driven so that the toner can be conveyed.

The other end of each hose is connected with the pipe 259 of the toner distribution container 351 which is provided according to the color of the toner. The toner distribution container 251 has the toner supply inlet 257. The rails 254 are provided to the toner distribution container 251, and the opening and closing member 258 which slides on the rails 254 are also provided to the toner distribution container 251. The opening and closing member 258 is always pushed in the right direction in FIG. 5 by the pin 252 and the spring 255 which are provided to the extension portion 251A of the bottom of the toner distribution container 251. The toner supply inlet 257 is usually closed by the opening and closing member 258.

The extension portion 251A of the bottom of the toner distribution container 251 of the toner supply unit, is provided with the pins 266, 267 and 264 which engage with the long holes 708 and 709 provided to the frame 701 of the clam-shell opening and closing unit 700. The extension portion 251A is fixed to the bent portion 262 of the plate 261 which can slide in the direction of the long hole.

The frame 701 of the clam-shell opening and closing unit 700 is provided with the shaft 702, shown in FIGS. 5 and 6, which engages with the bearing unit 802 provided to the frame 801 of the base unit 800, and the frame 701 can be opened and closed, wherein the shaft 702 is used as a supporting point.

Figure 8:
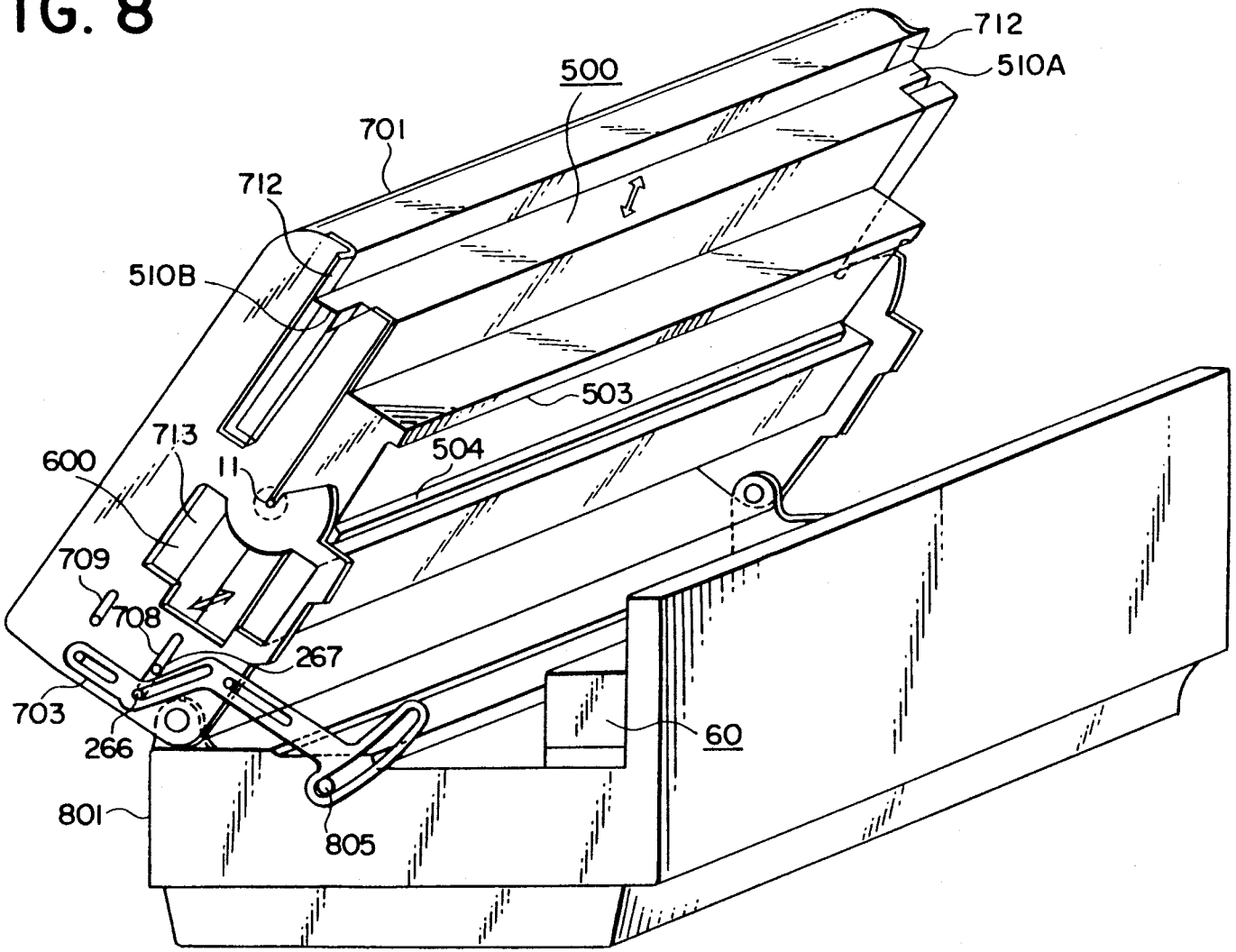
FIG. 8 is a perspective view of the clam-shell of the third example of the present invention, wherein the clam-shell is opened.

As shown in FIGS. 5 and 8, cam lever 703 provided with the grooves 703A, 703B, 703C and 703D, engages with the pins 704 and 705 fixed to the frame 701 of the clam-shell opening and closing unit 700, the pins 266 fixed to the above-described plate 261, and the pins 805 fixed to the frame 801 of the base unit 800.

When the clam-shell opening and closing unit is opened as illustrated in FIG. 8, the position of the cam lever 703 is changed as shown in the drawing. Accordingly, the pins 266, 267 and 264 move in the long holes 708 and 709. As a result, the plate 261 to which the pins are provided, moves in the left direction.

As explained above, the toner distribution container 252 the bottom extension portion 252A of which is fixed to the bent portion 262 of the plate 261, can be moved in the left directions as viewed in FIG. 5. When the toner distribution container 252 is moved in the left direction, it is separated from the container 603 of the developing unit and the toner supply inlet 257 is closed by the opening and closing member 258 which is pushed by the spring 255, so that the toner contained in the toner distribution container 251 can be prevented from dropping.

On the other hand, the toner receiving inlet 621 of the container 603 of the developing unit 600 is closed by the opening and closing member 618 which is pushed by the spring 617, wherein the opening and closing member 618 slides on the rail 619. The toner contained in the container 603 of the developing unit 600 is prevented from dropping.

As explained above, when the clam-shell opening and closing unit 700 is closed, the toner supply unit 250 is moved backward and the toner supply inlet 257 is closed. At the same moment, the toner receiving inlet 621 is also closed so that the toner is automatically prevented from dropping.

When the clam-shell opening and closing unit 700 is opened, the cartridge composed of Y, M and C developing units can be integrally attached to and removed from the apparatus through the opening 713, wherein the cartridge is guided by the guide rails 713A and 713B.

The developing unit 611D for use in the black toner forms an independent cartridge. The cartridge can be easily attached to and removed from the apparatus through the opening 713 provided to the frame 701 of the clam-shell opening and closing unit.

When the clam-shell opening and closing unit is opened as illustrated in the perspective view of FIG. 8, the photoreceptor drum cartridge 500 which is composed of the cleaning unit 100, the charger 20, the electrode 90 used before exposure and the toner recovery unit 130, can be easily attached to and removed from the apparatus, wherein the guide units 510A and 510B provided to both sides of the cartridge 500 are slidably guided along the guide rail introduction portion 712A and the guide rail 712, so that the drum center pin 11 can be set to the predetermined position being guided by the guide 711 provided to the frame.

The leg portions 503 and 504 are provided to the cartridge 500 so that the cartridge can be easily inspected and cleaned when the cartridge 500 is pulled out from the clam-shell opening and closing unit 700.

As explained above, when the clam-shell opening and closing unit is opened, each cartridge can be easily attached to and removed from the apparatus in order to inspect and maintain the cartridge. Accordingly, the cartridge can be easily replaced with a new one. As the three cartridges are provided to the apparatus, each color toner can be positively loaded to the cartridge without making a mistake. The above-described characteristics are advantageous in the case of multicolor image forming as well as full color image forming. Furthermore as the drum cartridge including the photoreceptor is provided meeting at right angles with the developing cartridge, the assembly work can be conducted more safely and positively in the above-described case than the case in which the drum cartridge are provided in parallel with the developing cartridge. It is preferable to attach and remove the photoreceptor cartridge earlier than the developing unit cartridge because the structure of the apparatus can be made simple in this case as compared with the reverse case. When the developing unit cartridge is attached to and removed from the apparatus earlier than the photoreceptor cartridge, the developing roller and other units must be withdrawn so that the surface of the photoreceptor can not be damaged by them. That is the reason why the structure becomes complicated when the developing unit cartridge is attached to and removed from the apparatus earlier than the photoreceptor cartridge. Although the structure becomes complicated in the case the developing unit cartridge is provided to the apparatus earlier than the photoreceptor cartridge, it is not so serious. However, it is preferable to avoid the case in which the structure of the apparatus becomes complicated.

In this example, the toner supply tank 200 and the toner supply unit 250 are provided to the apparatus. However, the alternative means which will be explained as follows may be adopted: the toner supply tank 200 and the toner supply unit 250 are not provided to the apparatus; the toner the amount of which corresponds to the life of the developing unit, is stored in the developing unit; when the toner was used up, the developing unit is replaced with a new one mounted on a new cartridge, wherein the old developing unit is discarded together with the cartridge.

In the example, the color developing units are mounted on a cartridge and the black developing unit is mounted on another cartridge. Consequently, the color developing units and the black developing unit can be replaced according to the frequency of use of each cartridge. However, when the apparatus is used as a multicolor image forming apparatus, a specific color is often used according to the usage of a customer. In such a case, an auxiliary cartridge may be provided to the main cartridge so that the developing unit of a color which is often used can be rapidly replaced.

As shown in the third example of the present invention, the maintenance and inspection of a photoreceptor and developing unit can be easily, positively, and effectively conducted.

When each image forming means has been used and worn out to the limit, the old cartridge can be immediately replaced with a new one so that the function can be recovered. Furthermore, the operation to recover the function is only to replace a cartridge, which is so simple and positive that not only an expert, but also an ordinary operator who does not have specific expertise can easily replace it. As the cartridges can be replaced according to the frequency of use, it is not necessary to use expensive materials and the cartridges can be reasonably replaced with new ones.

What is claimed is:

1. A color image forming apparatus for forming a color image comprising:

an image retainer for carrying said color image, a charging means for charging a surface of said image retainer, a means for forming a latent image on the charged surface of said image retainer, a multicolor developing means for developing said latent image, a black developing means for developing said latent image, a means for conveying a transfer sheet and transferring said developed latent image onto said transfer sheet, a cleaning means for cleaning a residual developer on the surface of said image retainer, a plurality of toner tanks positioned along a line which is parallel to an axis of said image retainer, a toner supplying means for supplying a plurality of color toners from said toner tanks to said multicolor developing means and said black developing means, a body means having an upper half member which is pivotally movable by a hinge means between an open position, where said detachable cartridges are capable of being removed from said apparatus, and a closed position, and means for coupling said toner supplying means to said toner tanks, wherein said coupling means releases said toner supplying means when said upper half member is at said open position.

* * * * *